US008225764B2

(12) United States Patent
Yoon et al.

(10) Patent No.: US 8,225,764 B2
(45) Date of Patent: Jul. 24, 2012

(54) CAM CARRIER ASSEMBLY

(75) Inventors: Seok Jun Yoon, Anyang-si (KR); Seung Woo Go, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 379 days.

(21) Appl. No.: 12/606,854

(22) Filed: Oct. 27, 2009

(65) Prior Publication Data

US 2010/0313838 A1 Dec. 16, 2010

(30) Foreign Application Priority Data

Jun. 16, 2009 (KR) ..... 10-2009-0053439

(51) Int. Cl.
*F01L 1/02* (2006.01)

(52) U.S. Cl. ..... 123/90.27; 123/90.16; 123/90.33; 123/90.44; 123/193.5

(58) Field of Classification Search ..... 123/90.27, 123/90.16, 90.33, 90.44, 193.5
See application file for complete search history.

(56) References Cited

U.S. PATENT DOCUMENTS 6,484,683 B2 11/2002 Zielke
7,913,660 B2 3/2011 Komura et al.

FOREIGN PATENT DOCUMENTS

JP 2004-116323 A 4/2004
JP 2005-248929 A 9/2005
JP 2007-9904 A 1/2007
JP 2007-170322 A 7/2007
JP 2007-315253 A 12/2007
JP 2008-75623 A 4/2008
KR 1995-0010232 Y1 12/1995
KR 10-2008-0080646 A 9/2008

OTHER PUBLICATIONS

Hamada et al., Valve Actuating System for Reciprocating Machine, US Patent Application Publication, Pub. No. US 2006/0266315, Nov. 30, 2006.*

* cited by examiner

*Primary Examiner* — Ching Chang

(74) *Attorney, Agent, or Firm* — Morgan, Lewis & Bockius LLP

(57) ABSTRACT

A cam carrier assembly may include at least a cam carrier mounted on a cylinder head and including a support, an actuator shaft, a portion of which is mounted in the support and rotatable to control a valve life, and a cap mounted on the cylinder head and coupled to the at least a cam carrier to rotatably support the portion of the actuator shaft and surrounding and rotatably supporting the other portion of the actuator shaft, which is not surrounded by the support.

10 Claims, 3 Drawing Sheets

CAM CARRIER ASSEMBLY

CROSS REFERENCE TO RELATED APPLICATION

This application claims priority to Korean Patent Application Number 10-2009-0053439 filed on Jun. 16, 2009 the entire contents of which application are incorporated herein for all purposes by this reference.

BACKGROUND OF THE INVENTION

1. Field of the Invention

The present invention relates to a cam carrier assembly and, more particularly, to a cam carrier assembly capable of stably supporting an actuator shaft while defining therein a novel oil circuit.

2. Description of Related Art

In a four-stroke gasoline engine, intake and exhaust valves generally serve to control intake into and exhaustion from a cylinder while hermetically sealing the cylinder. Specifically, the intake valve opens in intake stroke to thereby draw a fuel-air mixture into the cylinder, and the exhaust valve opens in exhaust stroke to thereby expel any remaining combustion gas out of the cylinder. In contrast, in compression and power strokes, both the intake and exhaust valves close to thereby hermetically seal the cylinder.

Valve types are divided into, for example, side valve (SV), overhead valve (OHV), and overhead camshaft (OHC) types according to the positions of cam shafts and valves. Among the OHC types, the double overhead camshaft (DOHC) type, with camshafts each dedicated to either an intake or exhaust valve, is generally used in vehicle engines.

The opening/closing of the valve is enabled when a cam on a camshaft pushes one end of the valve with a rocker arm. The camshaft is rotated by a driving force from a crank shaft, transmitted by, for example, a timing chain or a timing belt. A key factor determining the hermetic sealing, the amount of intake and exhaust gases, and so on is a valve lift. The valve lift is a scale representing the distance of a valve face from a valve seat. Generally, an increase in the valve lift leads to an increase in the amount of fuel-air gas drawn into the cylinder through the intake valve and to an increase in the amount of combustion gas expelled from the cylinder through the exhaust valve. Accordingly, intake and exhaust efficiency will increase in proportion to the valve lift.

A Continuously Variable Valve Lift (CVVL) system of the related art includes a control shaft having a control cam, a contact roller integrally coupled with a rocker arm and rotating in contact with a cam of a camshaft, and a swing arm contacting the rocker arm to adjust the valve lift. A cam carrier in the form of a single plate is typically used in order to facilitate assembling a cam or the like to the upper portion of a cylinder head.

A typical actuator shaft is about Φ8, and is subjected to a great amount of stress since it is driven by a motor. Accordingly, the cam carrier is required to adopt a structure for lubricating an actuator shaft and preventing the actuator from being deformed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide a cam carrier assembly that can stably support the actuator shaft while defining, therein, a lubrication passage feeding lubricating oil to an actuator shaft.

There is provided a cam carrier assembly capable of preventing a cam carrier assembly from being deformed by twisting.

In an aspect of the invention, the cam carrier assembly may include at least a cam carrier mounted on a cylinder head and including a support, an actuator shaft, a portion of which is mounted in the support and rotatable to control a valve life, and a cap mounted on the cylinder head and coupled to the at least a cam carrier to rotatably support the portion of the actuator shaft and surrounding and rotatably supporting the other portion of the actuator shaft, which is not surrounded by the support.

The support may include a first recess having a substantially semi-circular cross section so as to rotatably receive the portion of the actuator shaft therein.

The at least a cam carrier may further include a seating portion and a seating surface, the seating portion and the seating surface extending from the support along a longitudinal direction of the actuator shaft to an adjacent cam carrier, and wherein the seating surface is formed on one side of the seating portion and has an arc-shaped cross section to receive the other portion of the actuator shaft therein.

The cap may include a fixing portion fixedly contacting the support of the at least a cam carrier to rotatably support the portion of the actuator shaft and an extension fixedly contacting the seating portion to rotatably support the other portion of the actuator shaft.

The extension may include a seating surface having a substantially arc-shaped cross section such that the seating surface of the seating portion and the seating surface of the extension form a substantially semi-circular cross-section, while the at least a cam carrier and the cap are assembled, to rotatably support the other portion of the actuator shaft.

The fixing portion of the cap may include a second recess having a substantially semicircular cross section to rotatably receive the portion of the actuator shaft therein, wherein the first and second recesses define a mounting hole into which the portion of the actuator shaft is rotatably fitted, and wherein the mounting hole communicates with a lubrication passage that allows lubricating oil to pass through.

The mounting hole may fluid-communicate with the seating surfaces of the seating portion and the extension, wherein the lubrication passage is formed in the at least a cam carrier.

The lubrication passage may communicate with a cam lubrication passage feeding the lubricating oil to a cam and a swing arm lubrication passage feeding the lubricating oil to a swing arm, and wherein the lubrication passage, the cam lubrication passage, and the swing arm lubrication passage are formed in the at least a cam carrier.

In another aspect of the present invention, the fixing portion may include, a first vertical surface vertically contacting a side of the support of the at least a cam carrier, a horizontal surface extending from a lower end of the first vertical surface and horizontally contacting another side of the support, and a second vertical portion extending downwards from a distal end of the horizontal surface and vertically contacting the other side of the support.

The second vertical surface may include the second recess and the support including the first recess may be coupled to the second recess of the second vertical surface to define a mounting hole into which the portion of the actuator shaft is rotatably fitted, and wherein the mounting hole communicates with a lubrication passage that allows lubricating oil to pass through.

According to various aspects of the present invention, the actuator shaft can be stably fed with lubricating oil and be stably fixed. In particular, it is possible to feed oil to a lubricating mechanism of first and second cams (i.e., a CVVA device) and to the second cam by forming an effective oil circuit of two lines.

In addition, the structure of the cam carrier can be reinforced to prevent the cam carrier from being deformed by twisting, in which otherwise an engine may be damaged.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
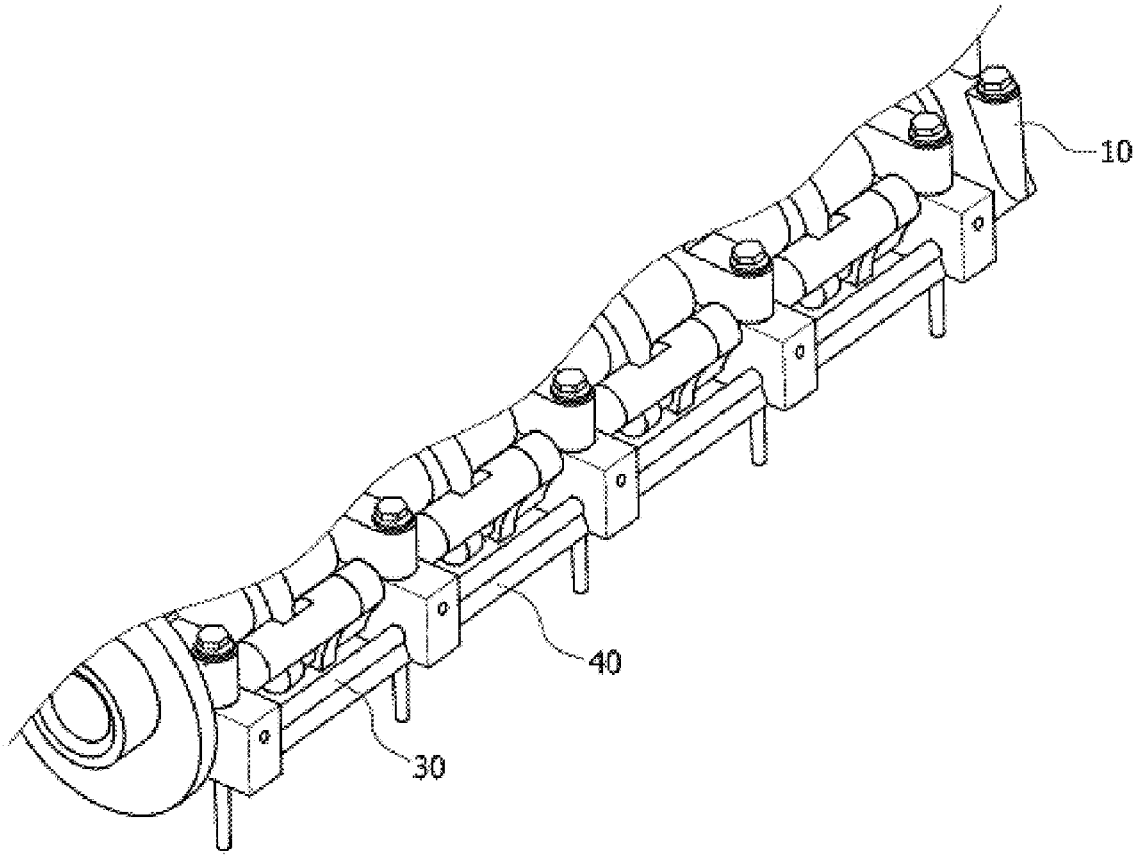
FIG. 1 is an assembled perspective view illustrating a portion of a cam carrier assembly in accordance with an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

In the accompanying drawings, the parts not essential to the present invention or similar to those of the related art are omitted or simplified for the sake of clarity.

First, the present invention will be described with reference to FIG. 1, which is an assembled perspective view illustrating a portion of a cam carrier assembly in accordance with an exemplary embodiment of the present invention.

The cam carrier assembly of this embodiment includes a cam carrier mounted on a cylinder head, an actuator shaft 30 fixed by the cam carrier 10, and a cap 40 supporting the actuator shaft 30. FIG. 1 shows only some portion of the cam carrier 10, but the other portion is omitted since they may make the subject matter of an exemplary embodiment of the present invention rather unclear.

As shown in FIG. 1, some portions of the actuator shaft 30 are exposed whereas the other portions of the actuator shaft 30 are surrounded by the cam carrier 10 and the cap 40. In particular, the cam carrier 10 and the cap 40 can seat and support, thereon, some portion of the underside of the actuator shaft 30.

The actuator shaft 30 is rotatable so as to adjust the lift of a valve. The actuator shaft 30 has a substantially cylindrical shape. The actuator shaft 30 can be rotated by a motor in order to adjust the lift of a Continuously Variable Valve Lift (CVVL) system.

Figure 2:
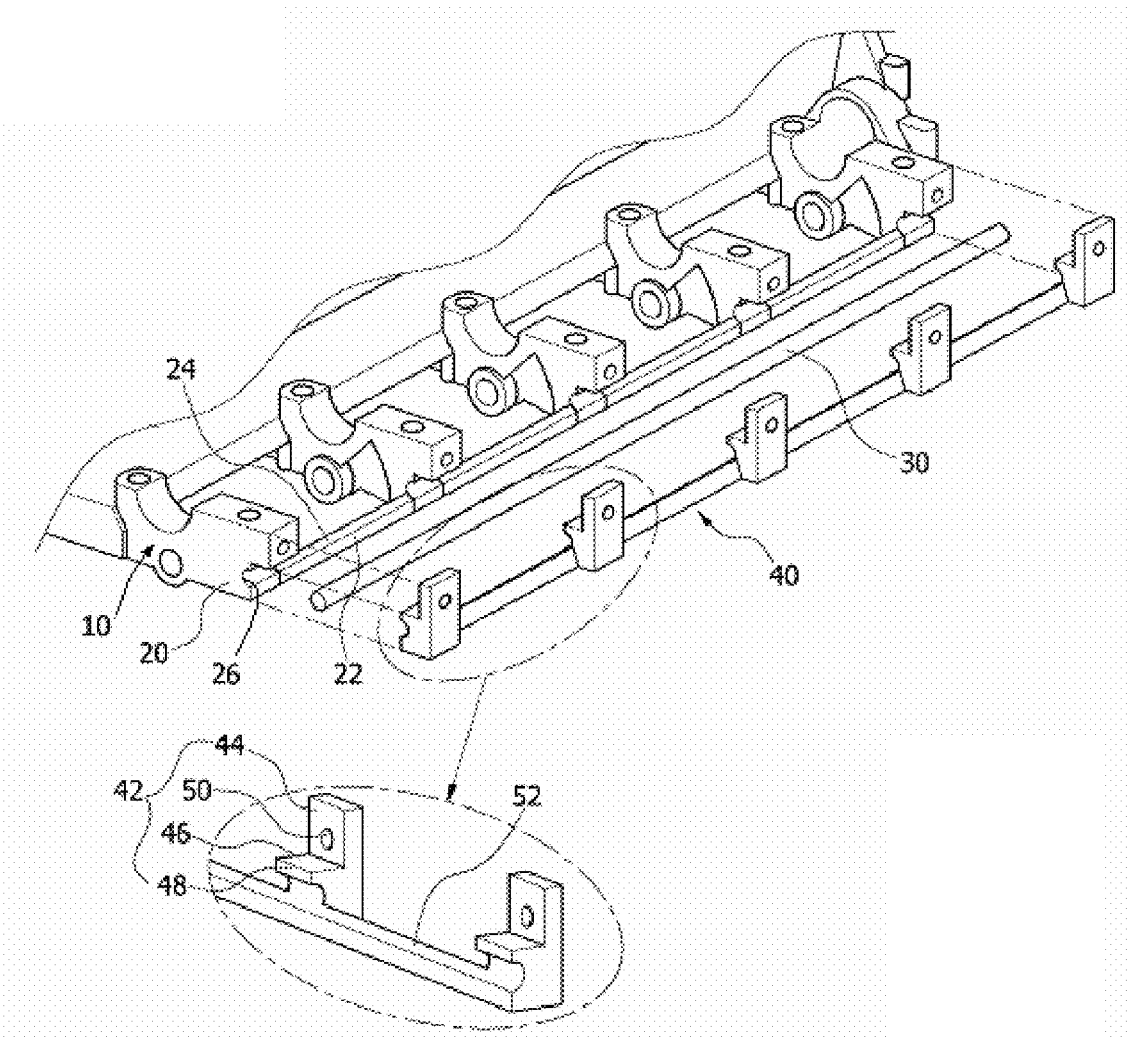
FIG. 2 is an exploded perspective view illustrating the a portion of the cam carrier assembly shown in FIG. 1.

Below, the exemplary embodiment of the present invention will be described with reference to FIG. 2, which is an exploded perspective view of the portion of the cam carrier assembly shown in FIG. 1.

The cam carrier 10 is mounted on the cylinder head, and has a number of components such as a cam shaft mounted thereon. The cam carrier 10 also defines a lubrication passage therein such that the components can be lubricated by oil as explained later.

A support 20 surrounding a portion of the actuator shaft 30 is disposed on one side of the cam carrier 10. The support 20 includes a recess 26, a seating portion 22, and a seating surface 24 thereof extending along the longitudinal direction of the actuator shaft 30.

The actuator shaft 30 is seated on the seating surface 24. Furthermore, the recess 26 may have a substantially semicircular cross section such that the actuator shaft 30 can stably rotate therein while maintaining contact with the seating surfaces 24. This feature can be realized due to the cylindrical overall shape of the actuator shaft 30.

The cap 40 is mounted on one side of the cam carrier 10, particularly, adjacent to the support 20 to fix the actuator shaft 30.

The cap 40 includes fixing portions 42 fixed to the support 20 and an extension 52 fixedly contacting the seating portion 22.

Like the support 20, the extension 52 has a seating surface capable of surrounding and supporting a portion of the actuator shaft 30. The seating surface of the extension 52 and the seating surface 24 of the seating portion 22 are joined together to surround about half of the cross section of the shaft 30. In particular, the seating surface of the extension 52 and the seating surface 24 of the seating portion 22 can surround the bottom of the actuator shaft 30. With this configuration, some portion of the actuator shaft 30 can be exposed without being concealed by the seating surface of the extension 52 or the seating surface 24 of the seating portion 22.

Each of the fixing portions 42 has a first vertical surface 44, a horizontal surface 46 and a second vertical surface 48, which are in contact with corresponding portions of the support 20. The first vertical surface 44, the horizontal surface 46, and the second vertical surface 48 are connected in sequence, thereby forming an "N" like shape (more particularly, similar to a figure"↵".

The first vertical surface 44 has a bolt hole 50 therein, and can vertically contact the support 20. The horizontal surface 46 horizontally extending from the lower end of the first vertical surface 44 can horizontally contact the support 20. The second vertical surface 48 vertically extending down from the distal end of the horizontal surface 46 can vertically contact the support 20.

In particular, the second vertical surface 48 has a recess that can cooperate with the corresponding portion of the support 20 to define a mounting hole 54 (see FIG. 3) as will be described later.

Figure 3:
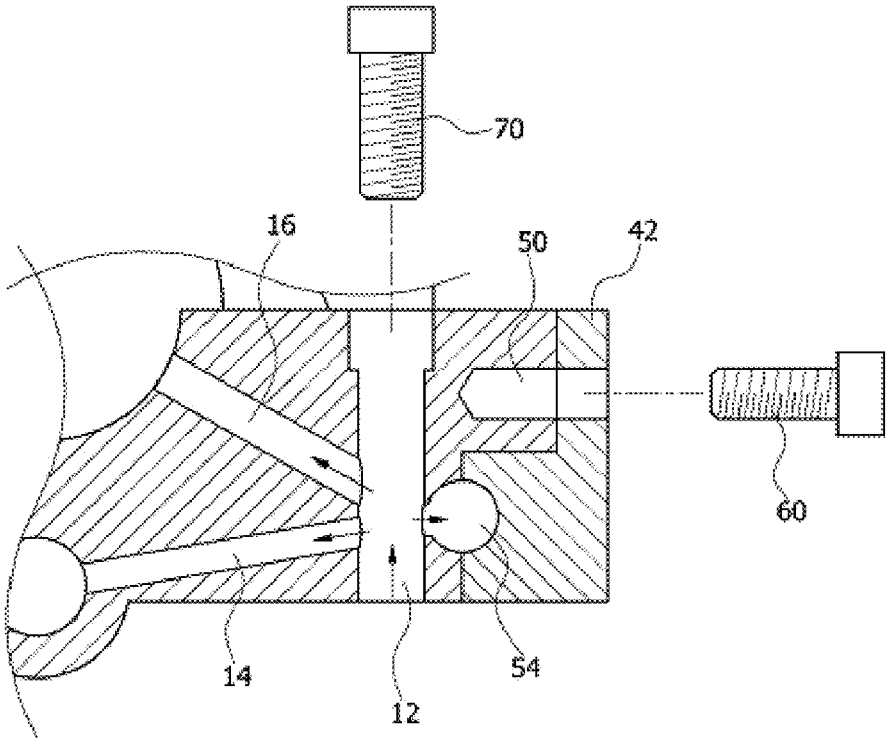
FIG. 3 is a cross-sectional view illustrating the a portion of the cam carrier assembly shown in FIG. 1.

Below, an exemplary embodiment of the present invention will be described with reference to FIG. 3, which is a cross-sectional view illustrating the a portion of the cam carrier assembly shown in FIG. 1. In FIG. 3, the cam carrier 10, the support 20 and the cap 40 are shown in an assembled state, but the actuator shaft 30 is omitted.

The mounting hole 54 is formed by the joint between the second vertical surface 48 and the corresponding portion of the support 20 (see FIG. 2), such that the actuator shaft 30 (see FIGS. 1 and 2) can be fitted into the mounting hole 54. The mounting hole 54 is formed by the joint between the recess of the support 20 and the recess of the second vertical surface 48. Thus, the cavity of the mounting hole 54 is divided into two parts, with one defined by the support 20 and the other one defined by the second vertical surface 48.

The cam carrier 10 defines, therein, a lubrication passage 12, through which lubricating oil can be fed and distributed. The lubrication passage 12 can communicate with an oil pump. In particular, the mounting hole 54 can communicate with the lubricating passage 12 to feed the lubricating oil to the actuator shaft, thereby lubricating the actuator shaft.

In addition, since the oil can gather in the semicircular passage, defined by the joint between the seating surface 24 of the seating portion 22 and the seating surface of the extension 52, the actuator shaft can be continuously lubricated.

In particular, the lubrication passage 12 in the cam carrier 10 can communicate with a cam lubrication passage 16 feeding lubricating oil to a cam and a swing arm lubrication passage 14 feeding lubricating oil to a swing arm. Thus, the actuator shaft can be lubricated using the lubrication passage 12 communicating with existing components such as the cam lubrication passage 16 and the swing arm lubrication passage 14.

Since various surfaces (i.e., three surfaces) of the fixing portion 42, such as the first vertical surface 44, the horizontal surface 46 and the second vertical surface 48, come into contact with the support 20, the fixing portion 42 can be more stably fixed. A bolt 60 is fixedly fitted into the bolt hole 50 in the first vertical surface 44.

When the actuator shaft is rotating, its motion may generate a force separating the cap 40 from the support 20. However, the horizontal surface 46 joined with the support 20 in a horizontal direction generates a frictional force that can reduce the separating force, and the lower portion of the second vertical surface 48 is pressed by the cylinder head. As a result, the cap 40 can be stably mounted on the support 20.

The fixing portion 42 has an "N" like overall shape (more particularly, similar to a figure "ㄹ"and is interposed between the cam carrier 10 and the cylinder head. Due to this interposed configuration of the fixing portion 42, the axial force of the bolt 60 fitted into the cam carrier 10 also helps the cap 40 be stably fixed to the support 20.

In addition, the bolt 70 can be fixedly fitted into the upper portion of the lubrication passage 12.

Now, the present invention will be described with reference to FIG. 4, which is a top plan view illustrating the cam carrier assembly shown in FIG. 1.

The support 20 provided on the cam carrier 10 can generally prevent the cam carrier 10 from being twisted. In particular, the seating portion 22 of the support 20 extending along the length is connected with protrusions of the cam carrier 10. Specifically, a mounting structure of the actuator shaft 30 can be provided on an either end of the lower part of the cam carrier 10, and the strength of the cam carrier 30 against a lateral directional force can be enhanced.

Figure 4:
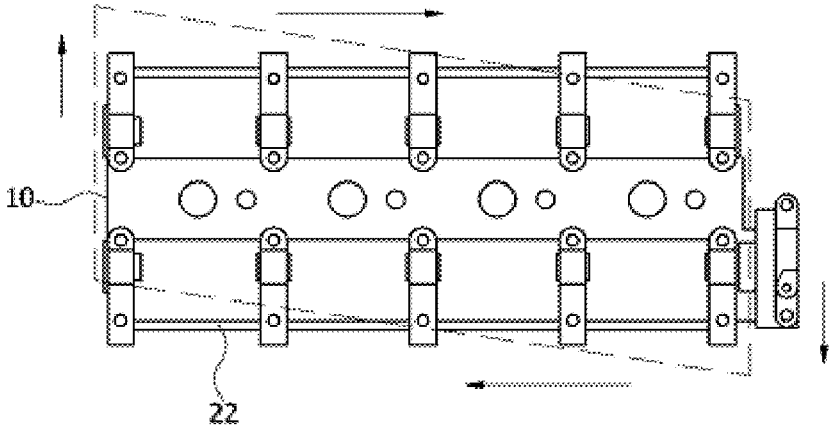
FIG. 4 is a top plan view illustrating the cam carrier assembly shown in FIG. 1.

As shown in FIG. 4, when clockwise twisting is applied, the cam carrier without the seating portion 22 may be deformed. In contrast, the seating portion 22 prepared as above can enhance rigidity to reduce the likelihood of torsional deformation.

A description will be given of the operation of the aforementioned cam carrier assembly.

The actuator shaft 30 is subjected to a great amount of stress since it determines the amount of valve lift. Accordingly, it is required to minimize a deformation in the actuator shaft 30.

According to one exemplary embodiment of the invention, only about half (½) of the actuator shaft 30 is surrounded and supported by the seating portion 22 and the extension 52. Of course, the actuator shaft 30 can be fixed to the cam carrier assembly so as to be rotatable. This is because, in places where the support 20 is joined with the fixing portions 42 of the cap 40, the actuator shaft 30 is entirely surrounded.

When an engine is running, lubricating oil is fed into the lubrication passage 12, and then into the cam lubrication passage 16 and the swing arm lubrication passage 14. The oil flows up to the mounting hole 54 communicating with the lubrication passage 12. Then, the oil can gather in the seating surface 24 of the seating portion 22 and the seating surface of the extension while flowing along the actuator shaft 30 fitted into the mounting hole 54. This, as a result, can facilitate lubrication of the actuator shaft 30.

In addition, the support 20, particularly, the seating portion 22 can enhance the rigidity of the cam carrier 10 to reduce twisting since it is provided on either side of the cam carrier 10.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cam carrier assembly comprising:

at least a cam carrier mounted on a cylinder head and including a support;

an actuator shaft, a portion of which is mounted in the support and rotatable to control a valve life; and a cap mounted on the cylinder head and coupled to the at least a cam carrier to rotatably support the portion of the actuator shaft and surrounding and rotatably supporting the other portion of the actuator shaft, which is not surrounded by the support;

wherein the at least a cam carrier further includes a seating portion and a seating surface, the seating portion and the seating surface extending from the support along a longitudinal direction of the actuator shaft to an adjacent cam carrier, and wherein the seating surface is formed on one side of the seating portion and has an arc-shaped cross section to receive the other portion of the actuator shaft therein;

wherein the cap includes a fixing portion fixedly contacting the support of the at least a cam carrier to rotatably support the portion of the actuator shaft and an extension fixedly contacting the seating portion to rotatably support the other portion of the actuator shaft;

wherein the extension includes a seating surface having a substantially arc-shaped cross section such that the seating surface of the seating portion and the seating surface of the extension form a substantially semi-circular cross-section, while the at least a cam carrier and the cap are assembled, to rotatably support the other portion of the actuator shaft;

wherein the fixing portion of the cap includes a second recess having a substantially semicircular cross section to rotatably receive the portion of the actuator shaft therein; and wherein the first and second recesses define a mounting hole into which the portion of the actuator shaft is rotatably fitted, and wherein the mounting hole communicates with a lubrication passage that allows lubricating oil to pass through.

2. The cam carrier assembly in accordance with claim 1, wherein the support includes a first recess having a substantially semi-circular cross section so as to rotatably receive the portion of the actuator shaft therein.

3. The cam carrier assembly in accordance with claim 1, wherein the mounting hole communicates with the seating surfaces of the seating portion and the extension to feed lubricating oil between the seating surfaces of the seating portion and the extension.

4. The cam carrier assembly in accordance with claim 3, wherein the lubrication passage is formed in the at least a cam carrier.

5. The cam carrier assembly in accordance with claim 4, wherein the lubrication passage communicates with a cam lubrication passage feeding the lubricating oil to a cam and a swing arm lubrication passage feeding the lubricating oil to a swing arm, and wherein the lubrication passage, the cam lubrication passage, and the swing arm lubrication passage are formed in the at least a cam carrier.

6. The cam carrier assembly in accordance with claim 1, wherein the fixing portion includes:

a first vertical surface vertically contacting a side of the support of the at least a cam carrier;

a horizontal surface extending from a lower end of the first vertical surface and horizontally contacting another side of the support; and a second vertical portion extending downwards from a distal end of the horizontal surface and vertically contacting the other side of the support.

7. The cam carrier assembly in accordance with claim 6, wherein the second vertical surface includes the second recess and the support including the first recess is coupled to the second recess of the second vertical surface to define a mounting hole into which the portion of the actuator shaft is rotatably fitted, and wherein the mounting hole communicates with a lubrication passage that allows lubricating oil to pass through.

8. The cam carrier assembly in accordance with claim 7, wherein the mounting hole communicates with the seating surfaces of the seating portion and the extension to feed lubricating oil between the seating surfaces of the seating portion and the extension.

9. The cam carrier assembly in accordance with claim 8, wherein the lubrication passage is formed in the at least a cam carrier.

10. The cam carrier assembly in accordance with claim 8, wherein the lubrication passage communicates with a cam lubrication passage feeding the lubricating oil to a cam and a swing arm lubrication passage feeding the lubricating oil to a swing arm, and wherein the lubrication passage, the cam lubrication passage, and the swing arm lubrication passage are formed in the at least a cam carrier.

* * * * *